US006691963B1

(12) United States Patent
Padiak et al.

(10) Patent No.: US 6,691,963 B1
(45) Date of Patent: Feb. 17, 2004

(54) PIVOTED CAM-LOCKING SIGN MOUNT

(75) Inventors: Scott Padiak, Winnetka, IL (US); Paul Charle Evans, Chicago, IL (US)

(73) Assignee: Cormark, Inc., Des Plaines, IL (US)

( * ) Notice: Subject to any disclaimer, the term of this patent is extended or adjusted under 35 U.S.C. 154(b) by 0 days.

(21) Appl. No.: 10/349,578

(22) Filed: Jan. 23, 2003

(51) Int. Cl.[7] ..... A47B 96/06; G09F 15/02

(52) U.S. Cl. ..... 248/220.22; 248/246; 248/297.21; 40/607.01; 40/617

(58) Field of Search ..... 248/220.22, 246, 248/297.21; 40/607.01, 617, 606.01, 607.02, 606.15, 606.18, 606.14, 607.11

(56) References Cited

U.S. PATENT DOCUMENTS 473,919 A * 5/1892 Edsall ..... 248/292.12
1,866,723 A * 7/1932 Powers ..... 248/282.1
2,787,433 A * 4/1957 Slavsky et al. ..... 248/231.71
4,616,799 A * 10/1986 Rebentisch ..... 248/289.31
4,881,707 A * 11/1989 Garfinkle ..... 248/222.12
5,472,289 A * 12/1995 Kringel et al. ..... 403/228
5,933,992 A 8/1999 Padiak et al.
6,086,033 A * 7/2000 Calleja ..... 248/240
6,364,262 B1 * 4/2002 Gibson et al. ..... 248/229.14
6,378,818 B1 * 4/2002 Padiak et al. ..... 248/201

* cited by examiner

*Primary Examiner*—Anita King
(74) *Attorney, Agent, or Firm*—Welsh & Katz, Ltd.

(57) ABSTRACT

A system for mounting a sign to a structure includes a pivoted cam-locking arrangement for retaining the sign in certain orientations relative to the structure, while allowing the sign to be rotated from one to another of those orientations.

8 Claims, 4 Drawing Sheets

PIVOTED CAM-LOCKING SIGN MOUNT

This invention pertains to sign mounting system. More particularly, it pertains to a pivoted cam-locking arrangement for mounting a sign to a structure. It incorporates some of the features disclosed in U.S. Pat. No. 5,933,992, which is incorporated herein by reference.

BRIEF DESCRIPTION OF THE DRAWINGS

The components in the figures are not necessarily to scale.

DETAILED DESCRIPTION OF SOME EMBODIMENTS

Figure 1:
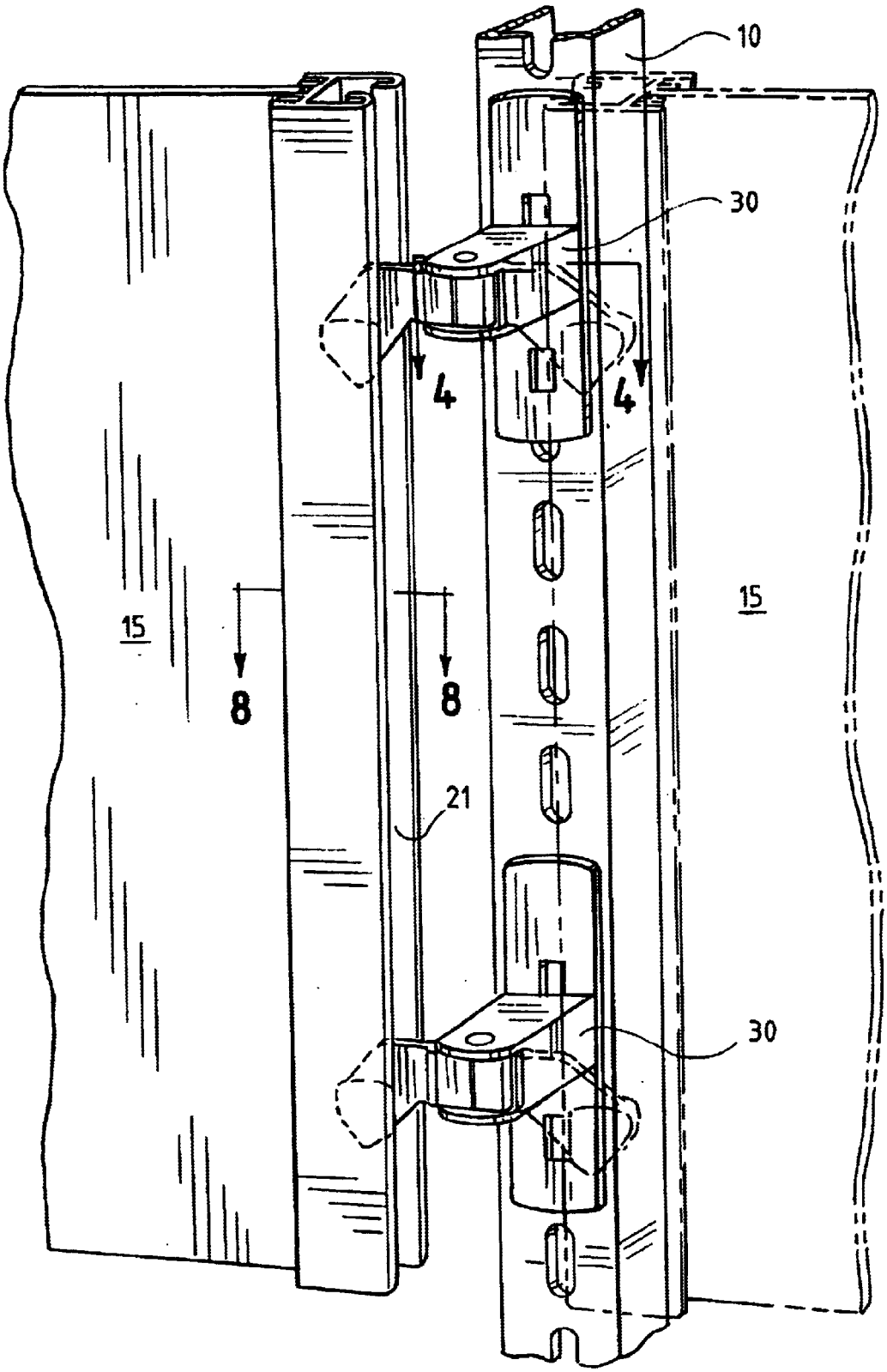
FIG. 1 is a perspective view of a sign mounted to a vertical structure in one simulated environment, with the sign pivoted to a second orientation shown in phantom.

While the present invention is susceptible of embodiment in various forms, there is shown in the drawings and will hereinafter be described some embodiments with the understanding that the present disclosure is to be considered an exemplification of the invention and is not intended to limit the invention to the specific embodiments illustrated.

Figure 2:
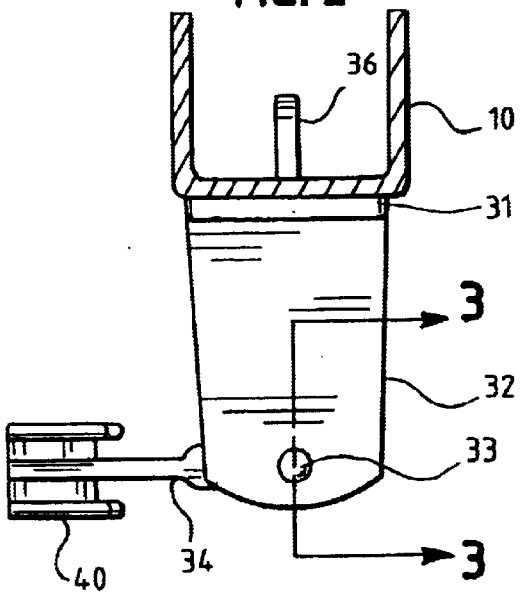
FIG. 2 is a top view of the mounting element in one simulated environment.

FIG. 1 is a perspective view and FIG. 2 is a top view, showing an example of mounting elements 30 attaching a sign or display to a supporting structure 10. Supporting structure 10 is vertical in the example of FIG. 1, but the invention is equally applicable to a supporting structure of any nature or orientation, and in particular to a horizontal supporting structure. A mounting element 30 can be secured to a supporting structure 10 by hooks, fasteners, or any of the myriad ways known to those skilled in the art.

A sign or display can be secured to a mounting element 30 by a frame, by clips, or by any of the myriad ways known to those skilled in the art. In the embodiment of FIG. 1, the sign or display includes a graphic panel 15 secured to a frame including a rail 21. Panel 15 can be mounted to a frame by an adhesive, for example.

Figure 8:
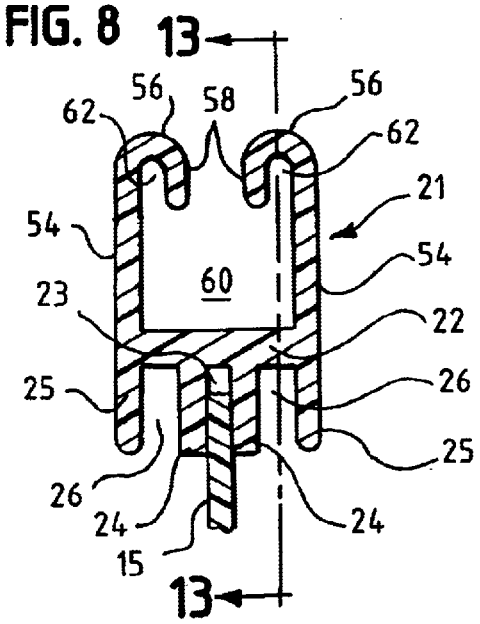
FIG. 8 is a partial top cross-section view taken along line 8—8 of FIG. 1.

FIG. 8 is a partial top cross-section view taken along line 8—8 of FIG. 1. As seen in the embodiment of FIG. 8, rail 21 has inner and outer flanges 24 and 25, respectively, that are joined by a runner portion 22. The inner flanges 24 define a space 23 that is configured to receive, for example, a sheet or panel 15, for mounting to rail 21. Alternately, spaces 26 are defined between each inner flange 24 and its respective outer flange 25 that can accommodate one or more sheets or panels 15.

One example application of a sign or display being mounted to structure 10 as in FIG. 1 would be to identify what is stored at a location along shelving. Such a sign or display could, for example, be a point-of-purchase display. It is advantageous if such a sign or display can be rotated readily to different positions, to allow access to shelving and to avoid being damaged by collisions with persons, shopping carts, forklifts, etc. moving near the shelving.

Figure 3:
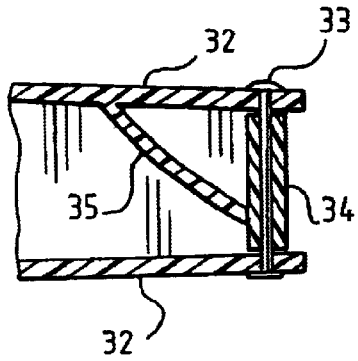
FIG. 3 is a partial side cross-section view taken along line 3—3 of FIG. 2.
Figure 4:
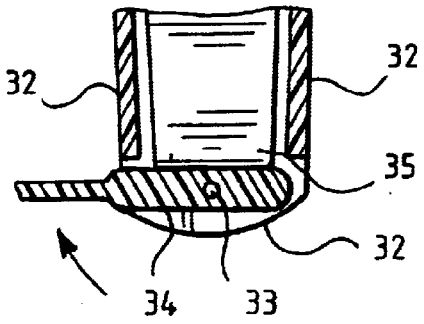
FIG. 4 is a partial top cross-section view taken along line 4—4 of FIG. 1.

FIG. 3 is a partial side cross-section view taken along line 3—3 of FIG. 2, and FIG. 4 is a partial top cross-section view taken along line 4—4 of FIG. 1. As best seen in FIGS. 3 and 4, in one embodiment a mounting element 30 comprises a housing 32. For example, housing 32 can be secured to supporting structure 10 directly or via connecting elements. In the embodiment of FIG. 2, housing 32 is integral with a base plate 31 which hooks into supporting structure 10 with at least one hook 36.

As best seen in FIGS. 3 and 4, in one embodiment a mounting element 30 also comprises a pivot 33 and an extension 34. For example, a sign or display can be secured to an outer end of extension 34 directly or via connecting elements. In the embodiment of FIG. 1, the outer end of extension 34 is connected to rail 21. One example of that connection is discussed further below.

In one embodiment, extension 34 is pivotally connected to housing 32 near an open end of housing 32, so that extension 34 and attached panel 15 can be rotated about pivot 33.

In one embodiment, a mounting element 30 also comprises a resilient member 35, and an attached end of resilient member 35 is attached to and may be integral with housing 32. In one embodiment, an inner end of extension 34 extends beyond pivot 33, and a free end of resilient member 35 extends nearly to pivot 33.

Figure 5:
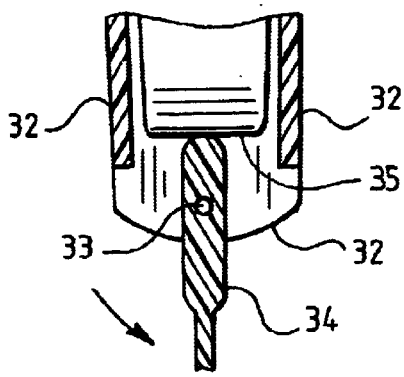
FIG. 5 is similar to FIG. 4 with the extension component of the mounting element rotated 90°.
Figure 6:
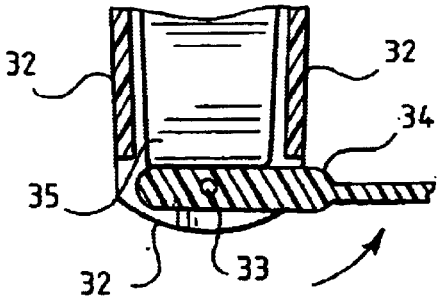
FIG. 6 is similar to FIG. 4 with the extension component of the mounting element rotated 180°.

FIGS. 5 and 6 are similar to FIG. 4 with the extension 34 rotated 90° and 180°, respectively, about pivot 33. For example, as extension 34 is rotated about pivot 33, the inner end of extension 34 will push against the free end of resilient member 35. As the inner end of extension 34 continues around to the other side, it will push less against the free end of resilient member 35 which will return to its initial, non-stressed position. That is, resilient member 35 should be sufficiently flexible that it will yield as extension 34 is rotated, but sufficiently resilient to return to its initial, non-stressed state without permanent deformation.

As best seen in FIG. 3, resilient member 35 can be shaped and can be attached to housing 32 so as to enhance its flexibility and resilience. For example, the resilient element 35 seen in FIG. 3 is curved and only its attached end is connected to housing 32.

In FIGS. 4 and 6, extension 34 is shown in opposite stationary orientations with respect to housing 32. These correspond to opposite stationary orientations of panel 15 with respect to supporting structure 10. However, in any intermediate orientation, such as shown in FIG. 5, resilient member 35 will tend to push the inner end of extension 34 toward one of the two stationary orientations.

Figure 7:
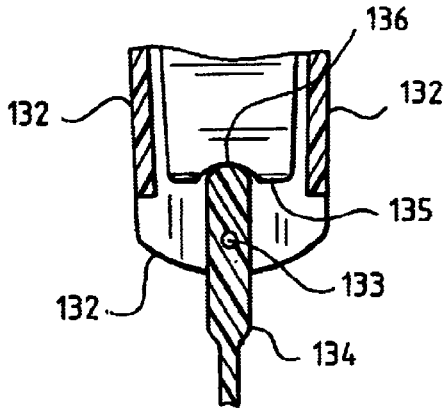
FIG. 7 is similar to FIG. 5, but showing an alternate embodiment with a stationary orientation at a 90° rotation.

FIG. 7 shows an alternate embodiment, with a notch 136 in the free end of resilient member 135. In the example of FIG. 7, the notch 136 in the free end of resilient member 135 provides for a stationary orientation when extension 134 has been rotated 90°. Similarly, the shapes and relationships between extension 134 and resilient member 135 can be modified to provide for other stationary orientations which are different than the examples illustrated in the figures.

One embodiment of the present system permits adjustably securing a mounting element 30 anywhere along the length of rail 21, so that the placement of a panel 15 can be optimized. By simply rotating a mounting element 30 relative to rail 21, and sliding mounting element 30 along rail 21, the location at which mounting element 30 secures to rail 21 can be selected and readily changed.

As seen in the embodiment of FIG. 8, rail 21 includes side walls 54 that extend from the runner portion 22 in substantially opposing relation to outer flanges 25. The walls 54 each terminate in an engaging lip 56 at a free end thereof. In one embodiment, the engaging lips 56 have generally J-shaped cross-sections, and the short sides 58 of the J-shaped cross-sections are opposingly oriented inwardly. In conjunction with the side walls 54 and runner portion 22, the engaging lips 56 define a track 60 for securing mounting elements 30 thereto. As best seen in FIG. 8, the track 60 includes mirror image shoulder regions 62 between the short sides 58 of the J-shaped cross-sections and the side walls 54.

Figure 9:
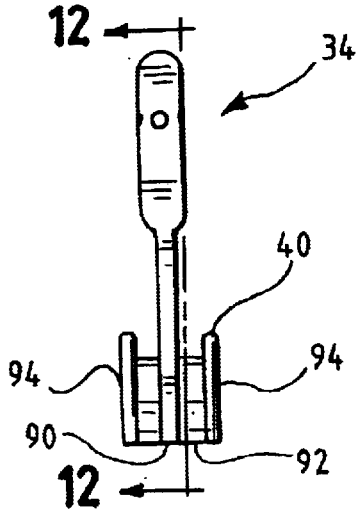
FIG. 9 is a top view of one embodiment of an extension component of a mounting element.
Figure 10:
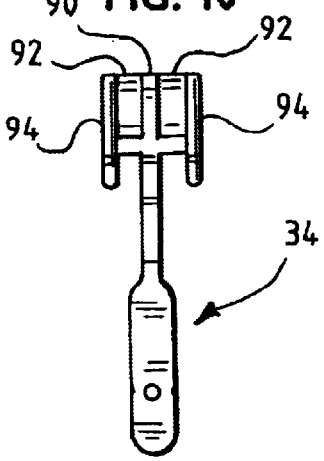
FIG. 10 is a bottom view of the extension component of FIG. 9.
Figure 11:
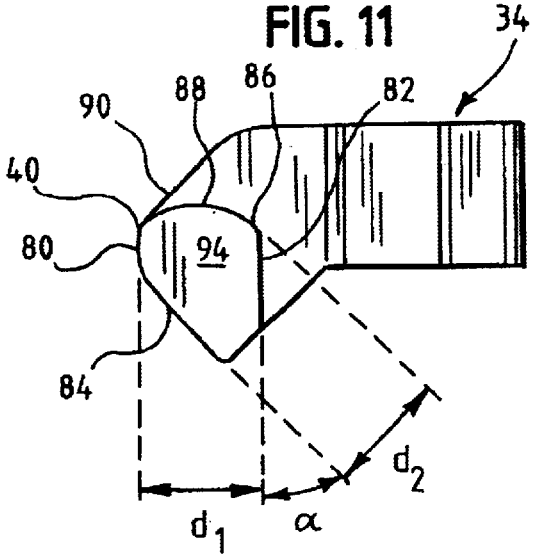
FIG. 11 is a side view of the extension component of FIG. 9.

FIG. 9 is a top view of one embodiment of extension 34 of a mounting element 30. FIGS. 10 and 11 are bottom and side views, respectively, of the extension 34 of FIG. 9. In the embodiment FIGS. 9 through 11, the extension 34 includes a shaft 90 which extends straight out from the pivoted inner end of extension 34, and then angles down toward the outer end of extension 34. In other embodiments, extension 34 can have any of a wide variety of sizes, shapes and orientations. For example, shaft 90 need not angle down but can angle up or can continue to extend straight out.

In the embodiment of FIGS. 9 through 11, the outer end of extension 34 comprises a cam portion 40. Cam portion 40 is configured to slide within track 60 of rail 21, and to lock into track 60 thus securing the mounting element 30 to the rail 21.

Figure 13A:
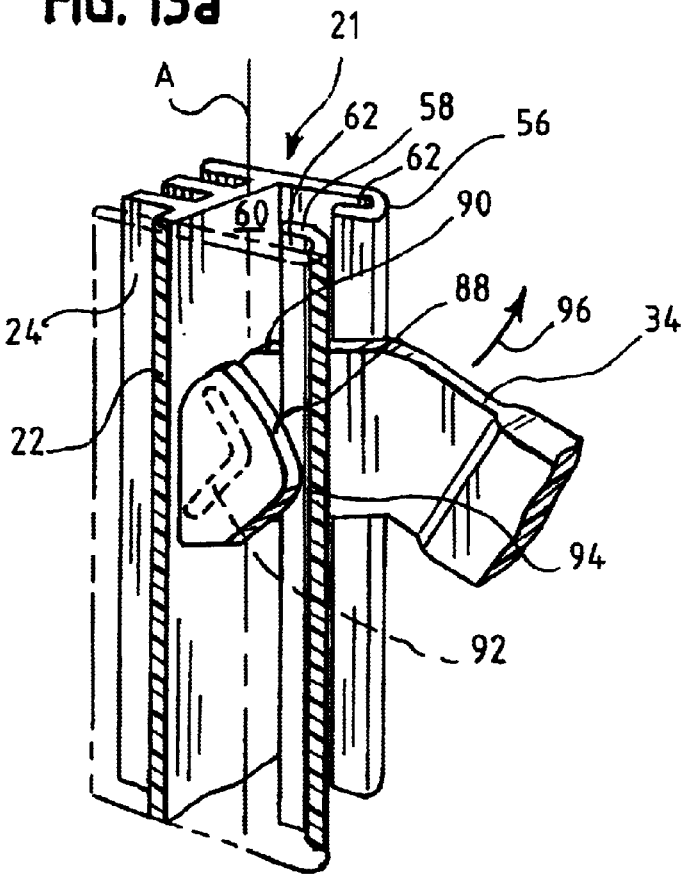
FIG. 13*a* is a partial perspective view taken along line 13—13 of FIG. 8, with the extension component of FIG. 9 inserted in the track shown in FIG. 8, and with a spacer component and a side wall shown in phantom.
Figure 13B:
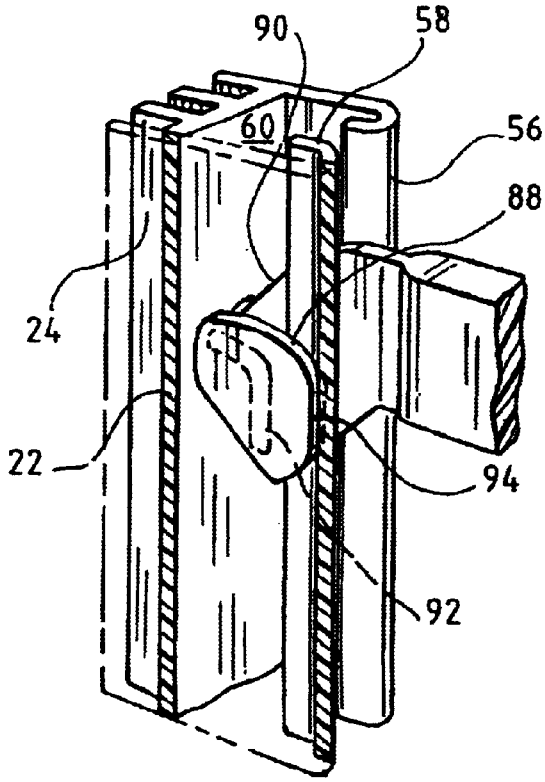
FIG. 13*b* is similar to FIG. 13*a* with the extension component rotated into a locked position.

To this end, the cam portion 40 is pivotal within track 60 between a sliding/adjusting position as illustrated in FIG. 13*a* and a locking/securing position as illustrated in FIG. 13*b*. FIG. 13*a* is a partial perspective view taken along line 13—13 of FIG. 8, with the extension 34 of FIG. 9 inserted in the track 60 of FIG. 8. In FIG. 13*a*, cam portion 40 freely slides or adjusts along the track 60. FIG. 13*b* is similar to FIG. 13*a* with the extension 34 rotated so that the cam portion 40 locks into the track 60 by engagement with the side walls 54, engaging lips 56, and runner portion 22.

Figure 12:
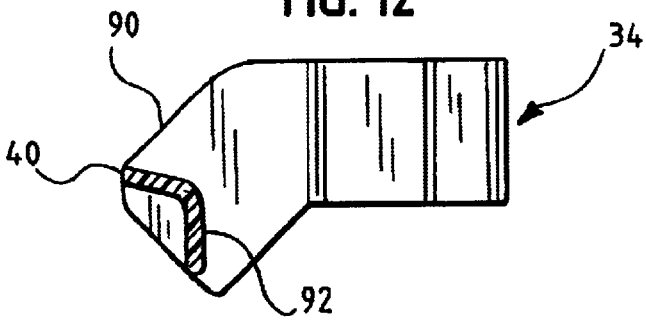
FIG. 12 is a side cross-section view taken along line 12—12 of FIG. 9.

FIG. 12 is a side cross-section view taken along line 12—12 of FIG. 9. In a preferred embodiment, the cam portion 40 comprises two parallel, mirror-image, outer walls 94, the outer end of shaft 90, and two spacers 92, as seen in FIGS. 9 through 12. The outer end of shaft 90 is parallel to outer walls 94, and spacers 92 separate the outer end of shaft 90 from the outer walls 94.

In the embodiment of FIG. 11, each outer wall 94 comprises an asymmetrical shape with first and second, generally parallel, locking edge surfaces 80 and 82. First and second locking edge surfaces 80 and 82 are spaced apart from one another a predetermined distance $d_1$. Each outer wall 94 also comprises first and second, generally parallel, sliding edge surfaces 84 and 86. First and second sliding edge surfaces 84 and 86 are space apart from one another a predetermined distance $d_2$, which is less than the distance $d_1$. The generally parallel locking edge surfaces 80 and 82 are at an angle $\alpha$ relative to the generally parallel sliding edge surfaces 84 and 86.

In a preferred embodiment, a rail 21 can be mounted to a supporting structure 10 using one or more mounting elements 30. The appropriate number and spacing of mounting elements 30 can be determined based on the desired location and orientation of a sign or display relative to the supporting structure 10.

Each mounting element 30 can be inserted into track 60 of rail 21, with the cam portion 40 oriented so that the sliding edge surfaces 84 and 86 are parallel to the track axis A as shown in FIG. 13*a*. When the desired location for a mounting element 30 is selected, the cam portion 40 can be rotated relative to rail 21 as indicated by the arrow at 96. The cam portion 40 is rotated so that the locking edge surfaces 80 and 82 engage the runner portion 22 and the lips 56, thus locking the mounting element 30 in the track 60. In this orientation, the locking edge surfaces 80 and 82 are parallel to the track axis A. The curved edge surface 88 facilitates rotating the cam portion 40 into or out of the locked position.

When the cam portion is in the locked position in a preferred embodiment (as in FIG. 13*b*), part of the outer walls 94 are in the shoulder regions 62, part of the short sides 58 are in space adjacent spacers 92 between the outer walls 94 and the shaft 90, and part of the shaft 90 is between the short sides 58. This prevents side walls 54 of rail 21 from bending, and provides further support for maintaining the cam portion 40 locked in track 60.

Repositioning the mounting element 30 along rail 21 is easily accomplished by rotating the cam portion 40 in the direction opposite that indicated by the arrow at 96, so that the sliding edge surfaces 84 and 86 are again parallel to the track axis A (as in FIG. 13*a*). The mounting element 30 can then be slid to the desired position, and rotating the cam portion 40 so that the locking edge surfaces 80 and 82 are parallel to the track axis A and engage runner portion 22 and lips 56 (as in FIG. 13*b*).

The members of a mounting element 30, such as housing 32, extension 34, and resilient member 35, can be formed of materials and by processes known to those skilled in the art. For example, these members can be formed of a plastic material and can be formed by an injection molding process. For example, polypropylene or high-density polyethylene can be used to provide the resilence desired for resilient member 35.

From the foregoing it will be observed that numerous modifications and variations can be effectuated without departing from the true spirit and scope of the novel concepts of the present invention. It is to be understood that no limitation with respect to the specific embodiments illustrated is intended or should be inferred.

What is claimed is:

1. A sign-mounting system for mounting a sign to a supporting structure, the system comprising:

a housing mountable to the supporting structure;

an extension member pivotally connected to the housing about a pivot axis;

a resilient member;

an inner end of the extension member extending beyond the pivot axis;

a free end of the resilient member extending close enough to the pivot axis that the free end of the resilient member can be displaced from an initial state by the inner end of the extension member when the extension member is rotated about the pivot axis;

the resilient member being sufficiently resilient to push the inner end of the extension member toward a stationary orientation, of the extention member with respect to the housing, when the free end of the resilient member has been displaced from its initial state;

the resilient member being sufficiently resilient to return to its initial state without permanent deformation after the free end is displaced from its initial state;

an elongated frame portion mountable to the sign;

the frame portion comprising a runner;

the frame portion further comprising at least one side wall;

the at least one side wall terminating in a lip;

the runner and the at least one side wall defining a track;

the lip spaced apart from the runner a first predetermined distance;

an outer end of the extension member insertable into the track;

the outer end of the extension member comprising at least one outer wall;

the at least one outer wall comprising first and second locking edge surfaces;

the at least one outer wall further comprising first and second sliding edge surfaces;

the first and second sliding edge surfaces spaced apart from each other a distance no greater than the first predetermined distance;

the first and second locking edge surfaces spaced apart from each other a distance greater than the first predetermined distance;

the outer end of the extension member adjustably positionable within the track when the at least one outer wall is rotated to a sliding orientation with the first and second sliding edge surfaces adjacent the runner and the lip;

the outer end of the extension member in a locked position within the track when the at least one outer wall is rotated to a locked orientation with the first and second locking edge surfaces in engagement with the runner and the lip.

2. The sign-mounting system as in claim 1, the stationary orientation comprising first and second stationary orientations;

the first and second stationary orientations being separated by about 180° as the extension member is rotated about the pivot axis.

3. The sign-mounting system as in claim 1, the free end of the resilient member comprising a notch;

the stationary orientation comprising a middle stationary orientation in which the inner end of the extension member is positioned in the notch.

4. The sign-mounting system as in claim 1, an attached end of the resilient member attached to the housing.

5. The sign-mounting system as in claim 1, an attached end of the resilient member integral with the housing.

6. The sign-mounting system as in claim 1, further comprising:

a base plate mountable to the supporting structure;

the housing attached to the base plate.

7. The sign-mounting system as in claim 1, further comprising:

a base plate mountable to the supporting structure;

the housing integral with the base plate.

8. The sign-mounting system as in claim 1, further comprising:

a base plate;

the housing attached to the base plate;

the base plate comprising at least one hook mountable to the support structure.

* * * * *